US007267115B2

(12) United States Patent
Naruse et al.

(10) Patent No.: US 7,267,115 B2
(45) Date of Patent: Sep. 11, 2007

(54) IGNITION APPARATUS FOR AN INTERNAL COMBUSTION ENGINE

(75) Inventors: Yusuke Naruse, Tokyo (JP); Koichi Okamura, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/408,051

(22) Filed: Apr. 21, 2006

(65) Prior Publication Data

US 2007/0137628 A1 Jun. 21, 2007

(30) Foreign Application Priority Data

Dec. 16, 2005 (JP) ..... 2005-363199

(51) Int. Cl.
*F02P 1/00* (2006.01)
*G01L 23/22* (2006.01)

(52) U.S. Cl. ..... 123/594; 123/406.28; 123/654; 73/35.08; 324/391

(58) Field of Classification Search ..... 123/594, 123/654, 655, 656, 406.11, 406.12, 406.23, 123/406.26, 406.28; 73/35.08; 324/380, 324/388, 391, 392, 399
See application file for complete search history.

(56) References Cited

U.S. PATENT DOCUMENTS 5,785,020 A * 7/1998 Takahashi et al. ..... 123/406.34
5,979,406 A * 11/1999 Aoki et al. ..... 123/406.37
6,000,276 A * 12/1999 Mogi et al. ..... 73/35.08
6,043,660 A * 3/2000 Bahr et al. ..... 324/380
6,196,054 B1 * 3/2001 Okamura et al. ..... 73/35.08
6,427,662 B2 * 8/2002 Tanaya et al. ..... 123/406.29
6,512,375 B1 * 1/2003 Yamada et al. ..... 324/399
6,557,537 B2 * 5/2003 Ikeda et al. ..... 123/606
6,615,811 B1 * 9/2003 Butler, Jr. ..... 123/606
6,920,783 B2 * 7/2005 Kesler ..... 73/118.1
6,954,074 B2 * 10/2005 Zhu et al. ..... 324/399
2005/0279337 A1 * 12/2005 Biljenga ..... 123/620

FOREIGN PATENT DOCUMENTS

JP 2004-156608 A 6/2004

* cited by examiner

*Primary Examiner*—John T. Kwon
(74) *Attorney, Agent, or Firm*—Sughrue Mion, PLLC

(57) ABSTRACT

The ignition apparatus includes an electronic control unit and an igniter. The igniter detects ions resulting from ignition, and sends an ion current output signal to the electronic control unit. The igniter has a waveform shaping circuit and an ion current detecting/outputting circuit. The waveform shaping circuit is adapted such that a voltage at an input terminal thereof becomes higher than a predetermined reference voltage to turn the switching element ON when the ignition signal is caused to flow through an electric load. The ion current detecting/outputting circuit has an output terminal which is connected to the input terminal and outputs therefrom an ion current output signal obtained as a result of conversion of an ion current, and is adjusted such that the voltage at the input terminal at the time when the ion current output signal is outputted to the electronic control unit becomes lower than the reference voltage.

9 Claims, 5 Drawing Sheets

IGNITION APPARATUS FOR AN INTERNAL COMBUSTION ENGINE

BACKGROUND OF THE INVENTION

1. Field of the Invention

The present invention relates to an ignition apparatus for an internal combustion engine mounted in, for example, an automobile, and more particularly to an ignition apparatus for an internal combustion engine in which a high voltage for ignition is generated in a secondary coil of an ignition coil by allowing and shutting off a flow of a current to a primary coil of the ignition coil by means of a switching element.

2. Description of the Related Art

A conventional ignition apparatus for an internal combustion engine is provided with resistors through which a current corresponding to an ion current and a current of an ignition signal are caused to flow, respectively, a comparator for comparing voltages generated in the resistors with each other, and a switch for making a switchover between the current of the ignition signal and the current corresponding to the ion current based on a result of the comparison, with a view to outputting an output from a circuit for detecting an ion current via the same route as is followed by the ignition signal (e.g., see JP 2004-156608 A).

However, this ignition apparatus is susceptible to an influence of a discrepancy in characteristics between the resistor configured on a coil side and the resistor for supplying the ignition signal and the influence of the potential of a ground GND, thereby causing problems in that the ignition signal cannot be supplied to a switching element with accuracy and that the size of the circuit is increased.

SUMMARY OF THE INVENTION

It is an object of the present invention to provide an ignition apparatus for an internal combustion engine which allows an ignition signal and an ion current output signal to be transmitted through a single signal line and prevents erroneous ignition from being caused even if disturbances are added to those signals during transmission thereof.

According to the present invention, an ignition apparatus for an internal combustion engine, includes: an electronic control unit for outputting an ignition signal for controlling an ignition timing; an igniter for allowing and shutting off flow of a current to a primary coil of an ignition coil by means of a switching element based on the ignition signal from the electronic control unit to thereby cause a high voltage for ignition to be generated in a secondary coil of the ignition coil, taking out ions, which are produced in an ignition plug as a result of ignition, as an ion current through application of a bias voltage, converting the ion current into an ion current output signal, and outputting the ion current output signal to the electronic control unit; and a signal line for allowing both the ignition signal and the ion current output signal to be transmitted therethrough. In the ignition apparatus, the igniter includes: a waveform shaping circuit having an input terminal to which the signal line is connected and an electric load is also connected in parallel, for being adapted such that a voltage at the input terminal rises above a predetermined reference voltage to turn the switching element ON when the ignition signal is caused to flow through the electric load; and an ion current detecting/outputting circuit having an output terminal connected to the input terminal to output therefrom the ion current output signal obtained as a result of conversion of the ion current, for being adjusted such that the voltage at the input terminal at a time when the ion current output signal is outputted to the electronic control unit becomes lower than the reference voltage.

In the ignition apparatus for the internal combustion engine according to the present invention, an ignition signal and an ion current output signal are transmitted through the single signal line, and there is set a difference between a voltage resulting from the ignition signal and a voltage resulting from the ion current output signal such that the switching element for generating a high voltage for ignition in the ignition plug is held OFF when the ion current output signal is transmitted. Thus, the ignition apparatus achieves an effect of preventing the size of the circuit from being increased.

DETAILED DESCRIPTION OF THE PREFERRED EMBODIMENTS

First Embodiment

Figure 1:
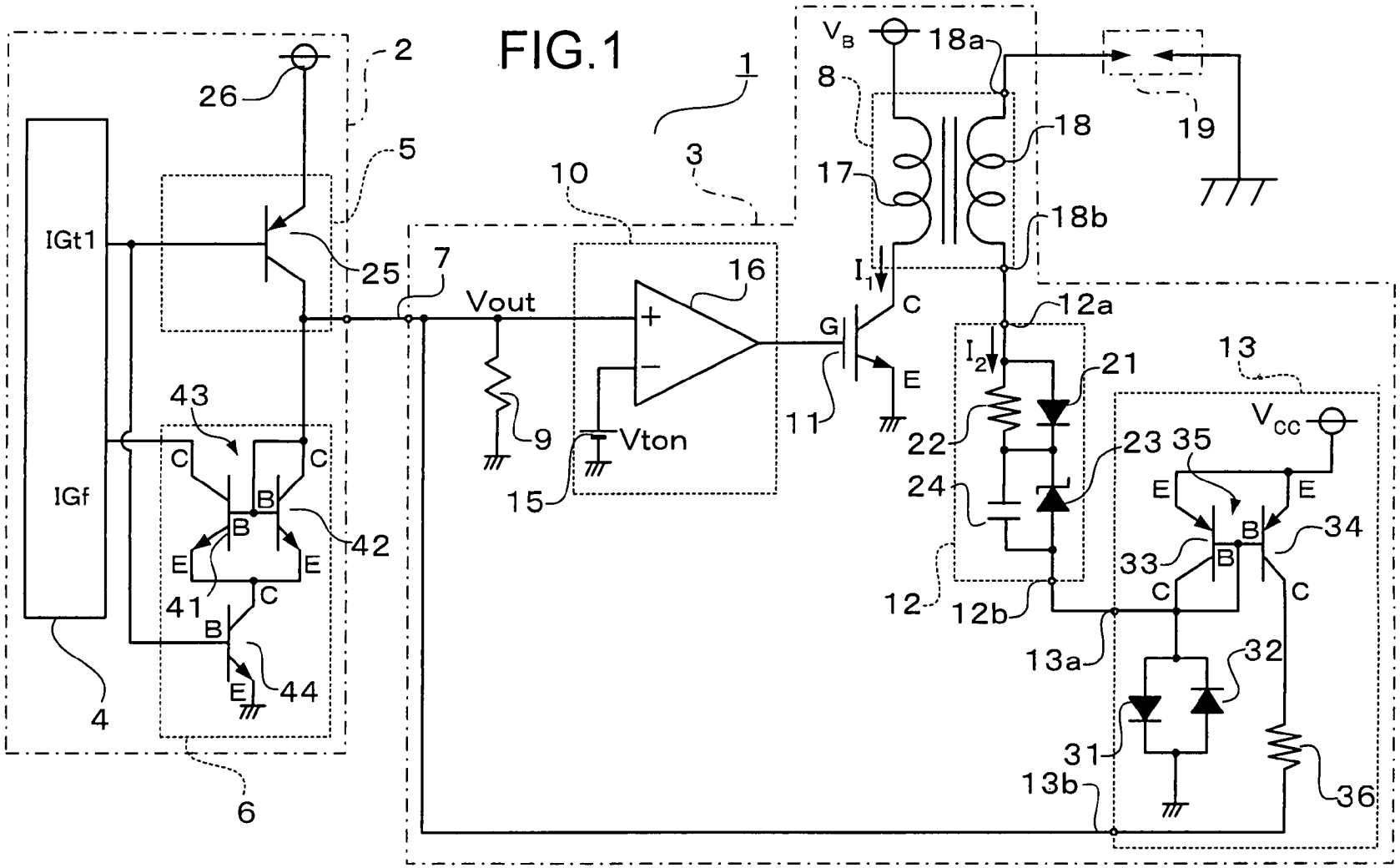
FIG. 1 is a circuit diagram of an ignition apparatus for an internal combustion engine according to a first embodiment of the present invention.
Figure 2:
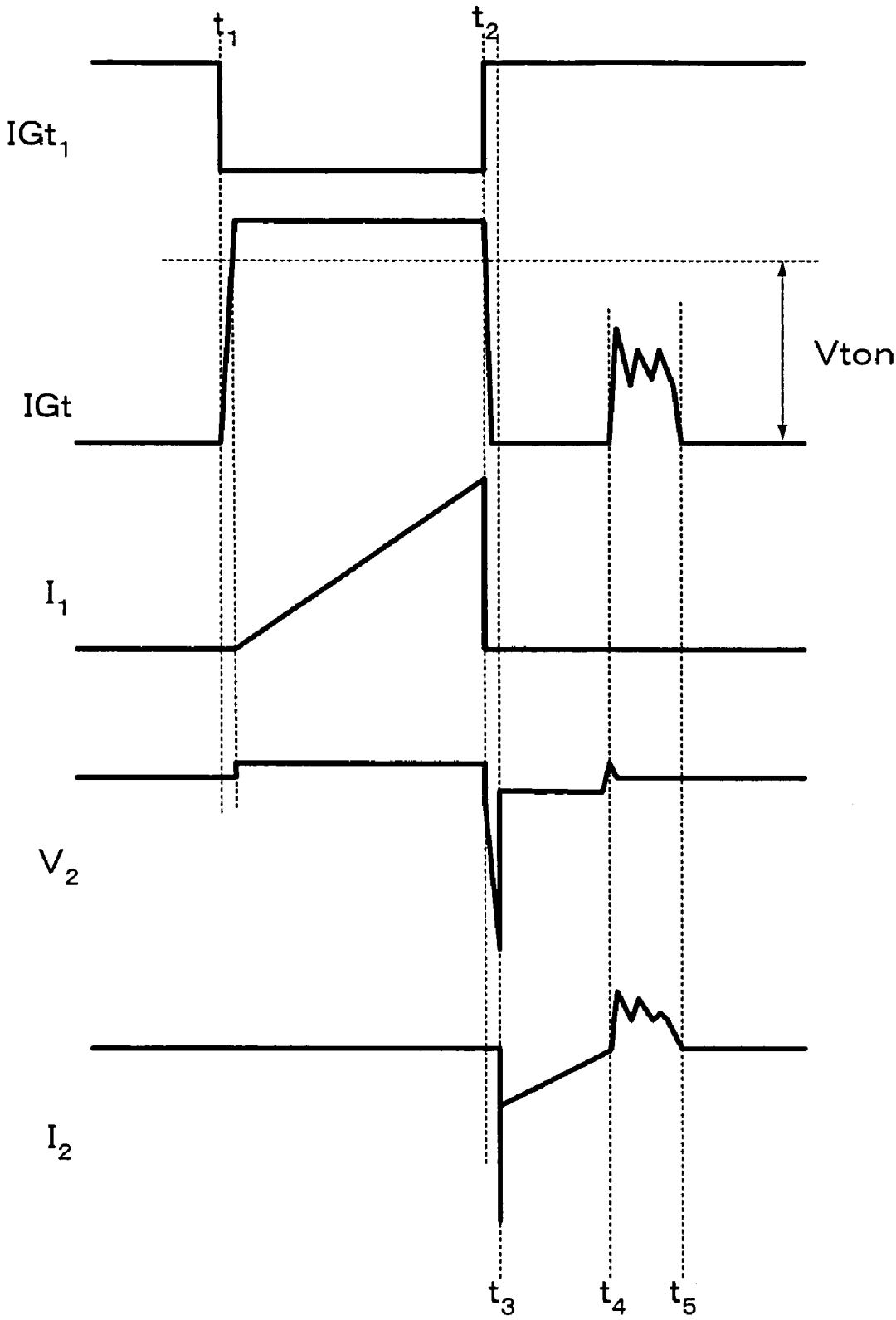
FIG. 2 shows timing charts of signals at respective portions of the ignition apparatus for the internal combustion engine according to the first embodiment of the present invention.

FIG. 1 is a circuit diagram of an ignition apparatus for an internal combustion engine according to a first embodiment of the present invention. FIG. 2 shows timing charts of signals at respective portions of the ignition apparatus for the internal combustion engine according to the first embodiment of the present invention.

An ignition apparatus 1 for an internal combustion engine (hereinafter referred to simply as the "ignition apparatus 1") according to the first embodiment of the present invention is designed as an ignition apparatus for an internal combustion engine mounted in an automobile. As shown in FIG. 1, the ignition apparatus 1 is composed of an electronic control unit 2 (hereinafter referred to as the "ECU 2") and an igniter 3.

The ECU 2 has a processing unit 4, an ignition signal driving circuit 5, and an ion control circuit 6.

The processing unit 4 sends out an ignition command signal $IGt_1$ at a desired timing, for example, at a time point $t_1$ based on a signal from a sensor (not shown) or the like, and analyzes an ion current output signal inputted after ignition.

In the ignition signal driving circuit 5, a transistor 25 is turned ON when the ignition command signal $IGt_1$ inputted to a base of the transistor 25 becomes low in level, so an ignition signal current flows from a power supply 26 to a ground GND via the transistor 25, a signal line 7, and an input resistor 9.

The ion control circuit 6 sends to the processing unit 4 only an ion current output signal transmitted from the igniter 3 via the signal line 7.

The ion control circuit 6 is composed of a current mirror circuit 43 and a transistor 44 having a push-pull circuitry. The current mirror circuit 43 is composed of transistors 41 and 42. A collector of the transistor 41 is connected to a collector of the transistor 42 and a positive input terminal of a comparator circuit 16 of a waveform shaping circuit 10. An emitter of the transistor 41 is connected to an emitter of the transistor 42 and a collector of the transistor 44. A base of the transistor 44 is connected to a terminal for outputting an ignition command signal of the processing unit 4. An emitter of the transistor 44 is connected to the ground GND.

The transistor 44 is turned OFF when the ignition command signal $IGt_1$ becomes low in level, and is turned ON when the ignition command signal $IGt_1$ becomes high in level. While a switching element 11 is ON, that is, while the ignition command signal $IGt_1$ is low in level, the transistor 44 is OFF. Therefore, an ignition signal IGt is not transmitted to the processing unit 4 as an ion current output signal, so the transistor 44 functions as a mask circuit.

The igniter 3 is composed of an ignition coil 8, the input resistor 9 as an electric load, the waveform shaping circuit 10, the switching element 11, an ion biasing circuit 12, and an ion current detecting/outputting circuit 13.

The waveform shaping circuit 10, which has a reference voltage source 15 and the comparator circuit 16, drives the switching element 11 by means of the ignition signal IGt from the ignition signal driving circuit 5. The signal line 7 is connected to the positive input terminal of the comparator circuit 16, and the reference voltage source 15 is connected to a negative input terminal of the comparator circuit 16. An output terminal of the comparator circuit 16 is connected to a gate of the switching element 11.

When the voltage inputted from the positive input terminal exceeds a reference voltage Vton of the reference voltage source 15, the voltage at the output terminal of the comparator circuit 16 changes in level from low to high.

The switching element 11 is, for example, an insulated gate bipolar transistor (IGBT) having a gate terminal G, a collector terminal C, and an emitter terminal E. The output terminal of the comparator circuit 16 is connected to the gate terminal G. A primary coil 17 of the ignition coil 8 is connected to the collector terminal C. The emitter terminal E is connected to the ground GND as a reference potential point of a body of an automobile or the like. In general, this reference potential point is referred to as an earth.

The ignition coil 8 has the primary coil 17 and the secondary coil 18. An output terminal of an on-vehicle battery or the like is connected to a power supply terminal $V_B$, to which the primary coil 17 is connected. The direct-current voltage at the output terminal of the on-vehicle battery is, for example, 12 V, and the voltage at the power supply terminal $V_B$ is 12 V.

An ignition plug 19 is connected to a high-voltage side 18*a* of the secondary coil 18. The ignition plug 19 is disposed in a combustion chamber of the internal combustion engine so as to ignite and burn a fuel such as gasoline which is supplied into the combustion chamber.

An input terminal 12*a* of the ion biasing circuit 12 is connected to a low-voltage side 18*b* of the secondary coil 18.

The ion biasing circuit 12 is provided with two terminals, that is, the input terminal 12*a* and an output terminal 12*b*. The output terminal 12*b* is connected to the ion current detecting/outputting circuit 13 disposed at a stage subsequent thereto. The input terminal 12*a* is connected to the low-voltage side 18*b* of the secondary coil 18.

An internal configuration of the ion biasing circuit 12 will now be described. The ion biasing circuit 12 has a diode 21, a resistor 22, a Zener diode 23, and a capacitor 24. An anode of the diode 21 and one terminal of the resistor 22 are connected to the low-voltage side 18*b* of the secondary coil 18. A cathode of the diode 21 and the other terminal of the resistor 22 are connected to a cathode of the Zener diode 23 and one terminal of the capacitor 24, respectively. An anode of the Zener diode 23 and the other terminal of the capacitor 24 are connected to the output terminal 12*b*.

The diode 21 suppresses a secondary voltage generated in the secondary coil 18 when a primary current rises in the primary coil 17, thereby preventing erroneous ignition. The resistor 22 secures a path through which an ion current flows. Due to the voltage generated at the high-voltage side 18*a* of the secondary coil 18, the Zener diode 23 and the capacitor 24 are charged with electric charges.

The ion current detecting/outputting circuit 13 is provided with two terminals, that is, an input terminal 13*a* and an output terminal 13*b*. The input terminal 13*a* is connected to the output terminal 12*b* of the ion biasing circuit 12. The output terminal 13*b* is connected to the signal line 7 at a location closer to the ECU 2 than a junction point of the input resistor 9.

An internal structure of the ion current detecting/outputting circuit 13 will now be described. The ion current detecting/outputting circuit 13 has two diodes 31 and 32, a current mirror circuit 35 including two transistors 33 and 34, and a resistor 36. An anode of the diode 31 and a cathode of the diode 32 are connected together, and a cathode of the diode 31 and an anode of the diode 32 are connected together, so a bidirectional diode is constituted. The anode of the diode 31 is connected to the input terminal 13*a*, and the cathode of the diode 31 is grounded.

An emitter of the transistor 33 and an emitter of the transistor 34 in the current mirror circuit 35 are connected to an internal power supply $V_{CC}$. A base of the transistor 33 is connected to a base of the transistor 34 and a collector of the transistor 33. The collector of the transistor 33 is connected to the input terminal 13*a*. On the other hand, a collector of the transistor 34 is connected to the output terminal 13*b* via the resistor 36.

Next, an operation of the ignition apparatus 1 will be described with reference to FIG. 2.

The ignition command signal $IGt_1$ is inputted to the ignition signal driving circuit 5 from the processing unit 4 at the time point $t_1$, and the ignition signal driving circuit 5 is turned ON, so an ignition signal current flows through the input resistor 9. When the ignition signal current flows through the input resistor 9, a voltage Vout of the signal line 7 rises. When the voltage Vout at the positive input terminal of the comparator circuit 16 becomes equal to or higher than the reference voltage Vton set in the reference voltage source 15, the switching element 11 is turned ON. As a result, a primary current $I_1$ is caused to flow through the primary coil 17.

After that, when the voltage Vout at the positive input terminal of the comparator circuit 16 falls below the reference voltage Vton at a time point $t_2$, the switching element 11 is turned OFF. The ignition command signal $IGt_1$ becomes high in level after the time point $t_2$, so the transistor 44 of the ion control circuit 6 is turned ON.

At the moment when the switching element 11 is turned OFF, the primary current $I_1$ flowing through the primary coil 17 is shut off, and a high-voltage is generated in the collector C of the switching element 11.

This high voltage is converted into a negative voltage capable of insulating and destroying a gap of the ignition plug 19, and applied to the secondary coil 18. Then, at a time point $t_3$ when the gap of the ignition plug 19 is insulated and destroyed, a secondary current $I_2$ flows from the ignition plug 19 side to the secondary coil 18 and then to the ground GND via the diode 21, the Zener diode 23, and the diode 31.

After that, at a time point $t_4$ when discharge is terminated, a voltage generated due to the electric charges with which the capacitor 24 is charged is biased in the gap of the ignition plug 19 and applied to ions generated as a result of combustion in a cylinder. An ion current thereby flows to the secondary coil 18 via the resistor 22. The transistor 33 is turned ON at this moment, so the current mirror circuit 35 is operated.

Since the transistor 44 is ON, the transistor 34 of the current mirror circuit 35 supplies a collector current corresponding to an iron current, which has flown via the transistor 33, to the ion control circuit 6 in the ECU 2.

When a current corresponding to an ion current flows through the transistor 42 of the current mirror circuit 43, it flows then to the transistor 41. The current corresponding to the ion current flows to the processing unit 4. This current corresponding to the ion current is an ion current output signal.

It should be noted that the voltage at the positive input terminal of the comparator circuit 16 is obtained by subtracting a voltage between the collector and the emitter of the transistor 34 and a fall in voltage at the resistor 36 from a voltage of the internal power supply $V_{CC}$ in a time zone in which the ion current flows. By setting the voltage at the positive input terminal of the comparator circuit 16 lower than the reference voltage Vton, the current corresponding to the ion current can be caused to flow through the signal line 7 while the output of the comparator circuit 16 is held low.

The ignition apparatus 1 as described above can cause a current corresponding to an iron current to flow through the common signal line 7 without allowing the output of the comparator circuit 16 to become high in level or allowing a high voltage to be applied to the ignition plug 19, thereby making it possible to prevent the size of the circuit from being increased.

The current mirror circuit 35 is configured in the ion current detecting/outputting circuit 13, and a current corresponding to an ion current is caused to flow through the ion control circuit 6. Therefore, unlike the case of a voltage, stable control can be performed without being influenced by fluctuations in the potential at the ground GND.

The ion control circuit 6 is provided with the transistor 44, which is OFF when an ignition signal is sent thereto, so the ion control circuit 6 is OFF when the ignition signal is sent thereto. Therefore, the ignition signal can be reliably transmitted to the comparator circuit 16 and the components subsequent thereto. As a result, an improvement in reliability can be achieved.

The transistor 25, which is turned ON when the ignition command signal is low in level, and the transistor 44, which is turned ON when the ignition command signal is high in level, are configured as the push-pull circuit. Therefore, the configuration of a circuit for separating an ignition signal from an ion current output signal can be simplified.

Second Embodiment

Figure 3:
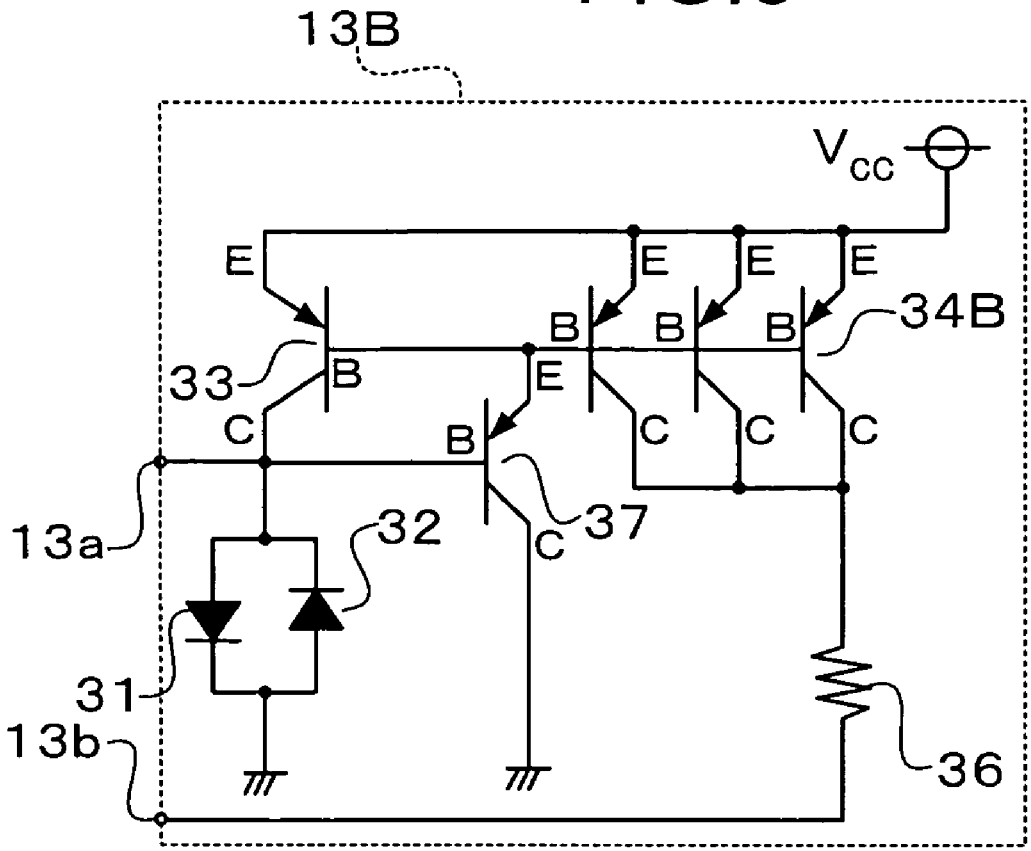
FIG. 3 is a circuit diagram of an ion current detecting/outputting circuit according to a second embodiment of the present invention.

FIG. 3 is a circuit diagram of an ion current detecting/outputting circuit 13B according to a second embodiment of the present invention.

As shown in FIG. 3, the ion current detecting/outputting circuit 13B according to the second embodiment of the present invention is different from the ion current detecting/outputting circuit 13 according to the first embodiment of the present invention in that a group of a plurality of transistors 34B is employed instead of the transistor 34, and in that a base current compensating transistor 37 for compensating for a base current flowing through the group of the transistors 34B is added. Since they are identical in other respects, the same description will be omitted by allocating like reference symbols to like components.

An emitter of the base current compensating transistor 37 is connected to a base of the transistor 33, a base of the base current compensating transistor 37 is connected to a collector of the transistor 33, and the collector of the base current compensating transistor 37 is connected to the ground GND.

The ignition apparatus for an internal combustion engine as described above compensates for a base current flowing through the group of the transistors 34B by means of the base current compensating transistor 37, thereby making it possible to amplify a current corresponding to an ion current by means of the group of the transistors 34B and cause the amplified current to flow through the ion control circuit 6. As a result, such an amount of current as to tolerate disturbances can be ensured, so more stable control can be performed.

Third Embodiment

Figure 4:
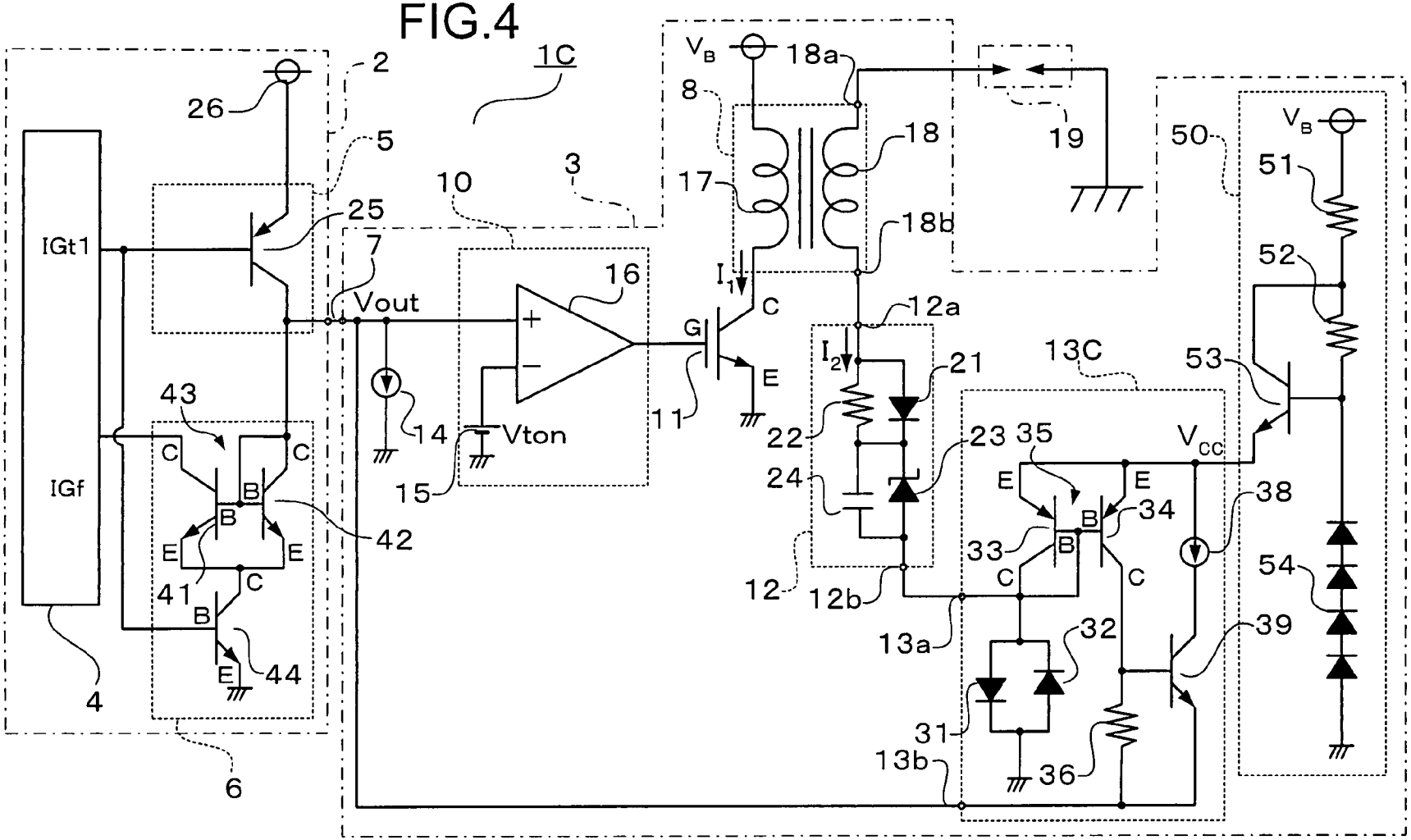
FIG. 4 is a circuit diagram of an ignition apparatus for an internal combustion engine according to a third embodiment of the present invention.

FIG. 4 is a circuit diagram of an ignition apparatus 1C for an internal combustion engine (hereinafter referred to simply as the "ignition apparatus 1C") according to a third embodiment of the present invention.

As shown in FIG. 4, the ignition apparatus 1C according to the third embodiment of the present invention is different from the ignition apparatus 1 according to the first embodiment of the present invention in that a power supply circuit 50 is added, and in that an ion current detecting/outputting circuit 13C and a first constant current circuit 14 as an electric load are employed instead of the ion current detecting/outputting circuit 13 and the input resistor 9, respectively. Since they are identical in other respects, the same description will be omitted by allocating like reference symbols to like components.

The first constant current circuit 14 causes a constant current to flow from the power supply 26 to the transistor 25 and the signal line 7 when the transistor 25 in the ignition signal driving circuit 5 is turned ON.

While the ion current detecting/outputting circuit 13 is provided with the internal power supply $V_{CC}$ in the first embodiment of the present invention, the power supply circuit 50, which generates the internal power supply $V_{CC}$ from a power supply $V_B$ supplied with power from a battery, is provided in the third embodiment of the present invention.

The power supply circuit 50 has two resistors 51 and 52, a transistor 53, and a clamping diode 54. One terminal of the resistor 51 is connected to the power supply $V_B$, and the other terminal of the resistor 51 is connected to an emitter of the transistor 53 and one terminal of the resistor 52. The other terminal of the resistor 52 is connected to a base of the transistor 53 and a cathode of the clamping diode 54. An anode of the clamping diode 54 is connected to the ground GND. A collector of the transistor 53 is connected to the emitter of the transistor 34 in the ion current detecting/outputting circuit 13C. The voltage at the collector of the transistor 53 is equal to the voltage of the internal power supply $V_{CC}$.

The ion current detecting/outputting circuit 13C according to the third embodiment of the present invention is obtained by adding a second constant current circuit 38 and a transistor 39 to the ion current detecting/outputting circuit 13 according to the first embodiment of the present invention. The second constant current circuit 38 is interposed between the internal power supply $V_{CC}$ and an emitter of the base current compensating transistor 37. A base of the transistor 39 is connected between the collector of the transistor 34 and the resistor 36. A collector of the transistor 39 is connected to the output terminal 13*b*.

Next, an operation of the ignition apparatus 1C according to the third embodiment of the present invention will be described. However, the description of the operation will be limited to what is different from the first embodiment of the present invention without making reference to what is similar thereto.

When the ignition command signal $IGt_1$ becomes low in level and supplied to the base of the transistor 25, a current of the ignition signal IGt flows from the power supply 26 to the ground GND via the transistor 25 and the first constant current circuit 14.

When an ion current flows, a current corresponding to the ion current flows from the internal power supply $V_{CC}$ to the output terminal 13*b* via the transistor 34 and the resistor 36, and a constant current flows from the internal power supply $V_{CC}$ to the output terminal 13*b* via the second constant current circuit 38 and the transistor 39. The current corresponding to the ion current and the constant current are then superimposed on each other at the output terminal 13*b*. A component of a resultant current which corresponds to the constant current flows to the ground GND via the first constant current circuit 14, and the current corresponding to the ion current flows to the ground GND via the transistors 42 and 44.

By thus equalizing the intensity of the constant current flowing through the second constant current circuit 38 with the intensity of the constant current flowing through the first constant current circuit 14, only the current corresponding to the ion current can be supplied to the ion control circuit 6.

Since the power supply circuit 50 is equipped with a clamping circuit, the voltage generated at the time when a current corresponding to an ion current flows is suppressed. Therefore, by setting the voltage of the internal power supply $V_{CC}$ equal to or lower than the reference voltage Vton of the waveform shaping circuit 10, the current corresponding to the ion current can be supplied to the ECU 2 side without turning the waveform shaping circuit 100N.

In the ignition apparatus 1C as described above, the first constant current circuit 14 is connected to the positive input terminal of the waveform shaping circuit 10 to cause a constant current to flow through the signal line 7 as an ignition signal. Thus, the reliability of electric contact pertaining to, for example, a connector of the signal line 7 for connecting the ECU 2 to the igniter 3 can be enhanced.

When a current corresponding to an ion current is caused to flow, the same current as the current flowing through the first constant current circuit 14 is outputted from the second constant current circuit 38 in a superimposed manner, so only the current corresponding to the ion current can be supplied to the ion control circuit 6. As a result, the configuration of the circuit for separating the current corresponding to the ion current can be simplified.

Since the power supply circuit 50 is equipped with the clamping circuit, it is possible to ensure a margin for an erroneous operation in detecting and outputting an ion current. Consequently, the power supply circuit 50 is unsusceptible to the influence of disturbances.

Fourth Embodiment

Figure 5:
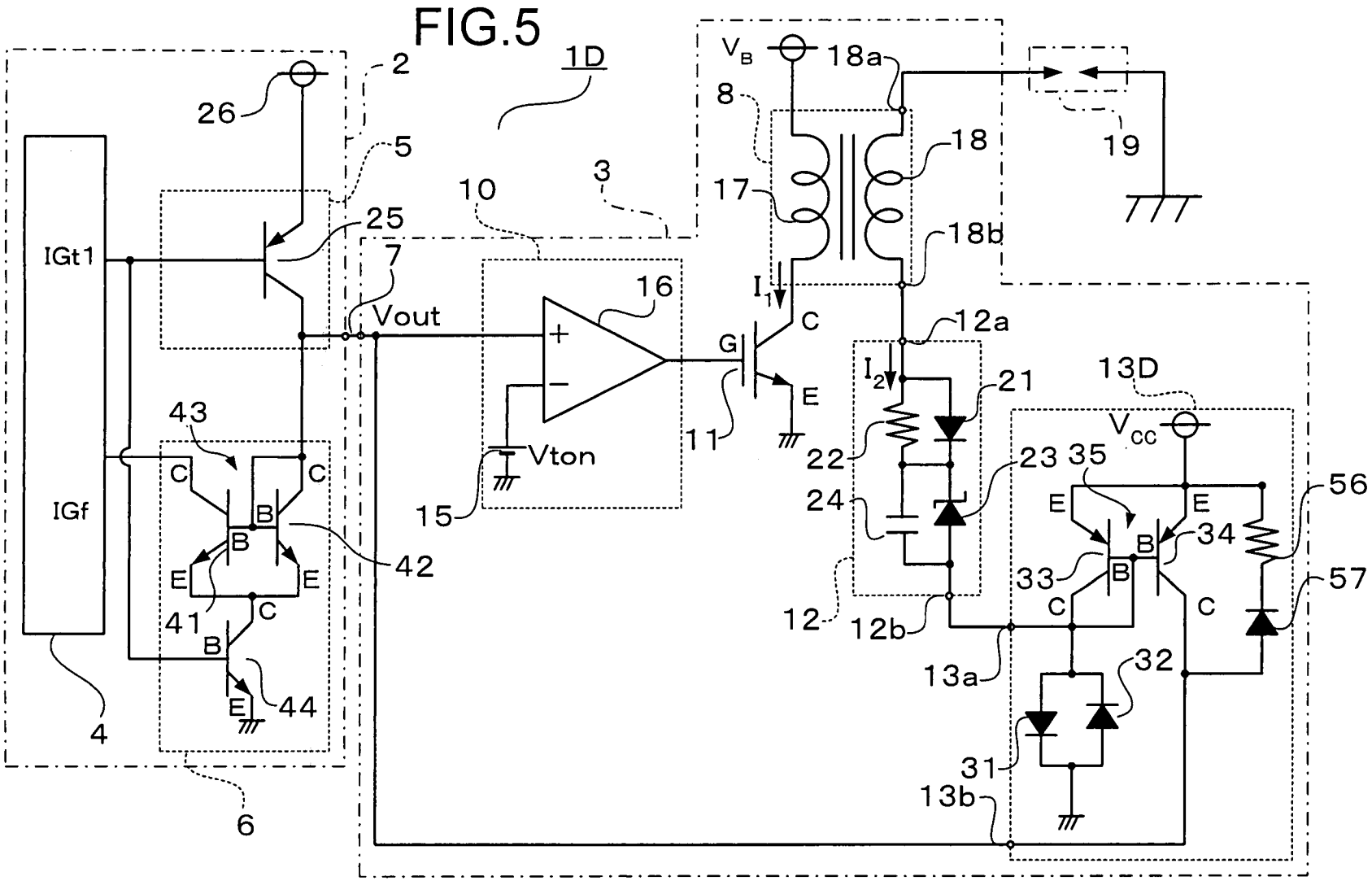
FIG. 5 is a circuit diagram of an ignition apparatus for an internal combustion engine according to a fourth embodiment of the present invention.

FIG. 5 is a circuit diagram of an ignition apparatus 1D for an internal combustion engine (hereinafter referred to simply as the "ignition apparatus 1D") according to a fourth embodiment of the present invention.

The ignition apparatus 1D according to the fourth embodiment of the present invention is different from the ignition apparatus 1 according to the first embodiment of the present invention in that an ion current detecting/outputting circuit 13D is employed and in that the input resistor 9 is omitted. Since they are identical in other respects, the same description will be omitted by allocating like reference symbols to like components.

The ion current detecting/outputting circuit 13D according to the fourth embodiment of the present invention is different from the ion current detecting/outputting circuit 13 according to the first embodiment of the present invention in that a resistor 56 and a diode 57 are connected between the emitter and the collector of the transistor 34. Since they are identical in other respects, the same description will be omitted by allocating like reference symbols to like components.

When the ignition command signal $IGt_1$ becomes low in level, the transistor 25 is turned ON, and an ignition signal current flows from the power supply 26 via the transistor 25, the signal line 7, the diode 57, and the resistor 56. The voltage Vout at the positive input terminal of the comparator circuit 16 at this moment is equal to a value obtained by adding a fall in voltage at the resistor 56 to the voltage of the internal power supply $V_{CC}$. If a circuit constant is set on the assumption that this value is equal to or higher than the reference voltage Vton, the output of the comparator circuit 16 becomes high in level when the ignition signal current flows therethrough. On the other hand, when the ignition command signal $IGt_1$ is high in level, no current flows through the diode 57 as a reverse bias because the potential of the collector of the transistor 25 is lower than the voltage of the internal power supply $V_{CC}$. A current corresponding to an ion current flows from the internal power supply $V_{CC}$ to the ground GND via the transistor 34, the transistor 42, and the transistor 44 only when the ion current flows through the transistor 33.

The ignition apparatus 1D as described above can ensure the reliability of contact pertaining to, for example, the connector of the signal line 7 for connecting the ECU 2 to the igniter 3 by causing an ignition signal current to flow from the power supply 26 to the internal power supply $V_{CC}$.

Since the input resistor 9 and the resistor 36 can be omitted, the circuit can be simplified.

In the fourth embodiment of the present invention, the transistor 34 of the ion current detecting/outputting circuit 13D is constructed as a single transistor. However, a similar effect is achieved even if a group of multiple transistors and a base current compensating transistor are employed as in the case of the second embodiment of the present invention.

In the foregoing description, the ignition apparatus according to any one of the first to fourth embodiments of the present invention is utilized as an ignition apparatus for an internal combustion engine mounted in an automobile. However, the ignition apparatus can also be utilized for an internal combustion engine mounted in a ship or an internal combustion engine employed as a mover for domestic or agricultural purposes.

What is claimed is:

1. An ignition apparatus for an internal combustion engine, comprising:

an electronic control unit for outputting an ignition signal for controlling an ignition timing;

an igniter for allowing and shutting off flow of a current to a primary coil of an ignition coil by means of a switching element based on the ignition signal from the electronic control unit to thereby cause a high voltage for ignition to be generated in a secondary coil of the ignition coil, taking out ions, which are produced in an ignition plug as a result of ignition, as an ion current through application of a bias voltage, converting the ion current into an ion current output signal, and outputting the ion current output signal to the electronic control unit; and a signal line for allowing both the ignition signal and the ion current output signal to be transmitted therethrough, wherein the igniter comprises: a waveform shaping circuit having an input terminal to which the signal line is connected and an electric load is also connected in parallel, for being adapted such that a voltage at the input terminal rises above a predetermined reference voltage to turn the switching element ON when the ignition signal is caused to flow through the electric load; and an ion current detecting/outputting circuit having an output terminal connected to the input terminal to output therefrom the ion current output signal obtained as a result of conversion of the ion current, for being adjusted such that the voltage at the input terminal at a time when the ion current output signal is outputted to the electronic control unit becomes lower than the reference voltage.

2. An ignition apparatus for an internal combustion engine according to claim 1, wherein the ion current output signal is a current output corresponding to the ion current.

3. An ignition apparatus for an internal combustion engine according to claim 1, wherein the ion current output signal is a current output obtained by amplifying the ion current.

4. An ignition apparatus for an internal combustion engine according to claim 2, wherein the ion current detecting/outputting circuit outputs a current corresponding to the ion current by performing a current mirror operation on the ion current.

5. An ignition apparatus for an internal combustion engine according to claim 1, wherein the electronic control unit prohibits detection of the ion current output signal when the ignition signal is supplied to the igniter.

6. An ignition apparatus for an internal combustion engine according to claim 5, wherein the electronic control unit employs a push-pull circuit to allow or prohibit detection of the ion current output signal by means of a current mirror circuit.

7. An ignition apparatus for an internal combustion engine according to claim 1, wherein:

the electric load is constructed as a first constant current circuit; and the ion current detecting/outputting circuit has a second constant current circuit for superimposing a constant current, which is equal in value to a constant current flowing through the first constant current circuit, onto the ion current output signal when the ion current output signal is supplied to the electronic control unit.

8. An ignition apparatus for an internal combustion engine according to claim 1, further comprising a power supply circuit equipped with a clamping circuit, for providing the ion current detecting/outputting circuit with a constant voltage power supply.

9. An ignition apparatus for an internal combustion engine according to claim 1, wherein the electric load is a diode, a resistor, or a constant current circuit connected in series to a constant voltage power supply.

* * * * *